United States Patent [19]

Zeder

[11] 4,028,691

[45] June 7, 1977

[54] THEFT DETERRING APPARATUS

[76] Inventor: Abraham Zeder, c/o Stajer Corp., 8 Winter Green Circle, Andover, Mass. 01810

[22] Filed: Apr. 2, 1976

[21] Appl. No.: 673,287

[52] U.S. Cl. ..... 340/280; 200/51 R

[51] Int. Cl.[2] ..... G08B 21/00

[58] Field of Search ..... 340/280, 256; 307/132 E, 140; 200/51 R, 42 R, 51.11, 61.58, 61.59; 317/148.5 R

[56] References Cited

UNITED STATES PATENTS

| | | | |
|---|---|---|---|
| 3,090,948 | 5/1963 | Cremer | 340/280 |
| 3,618,065 | 11/1971 | Trip | 340/280 |

*Primary Examiner*—John W. Caldwell
*Assistant Examiner*—William M. Wannisky
*Attorney, Agent, or Firm*—Jerry Cohen; Charles Hieken

[57] ABSTRACT

Theft of electrical appliances and the like is counteracted through provision of an alarm activated by removal of an electrical power line plug from an outlet by opening a normally closed or closing a normally open pair of contacts to gate a thyristor or relay and provide power through the thyristor or relay to a light, audible alarm or the like, the contacts being entirely hidden within the outlet. The alarm may also be activated by cutting a power line.

5 Claims, 8 Drawing Figures

THEFT DETERRING APPARATUS

BACKGROUND OF THE INVENTION

The present invention relates to theft preventing in stores, factories, warehouses, offices and various display installations, particularly in connection with electrical appliances plugged into electrical utility power outlets via line cord plugs from the appliance(s).

It is an important object of the invention to provide effective means for detection of theft or other unauthorized removal.

It is a further object of the invention to hide such means from the thief so that he will be unaware of their presence consistent with the preceding object.

It is a further object of the invention to provide easy resetting by the unskilled personnel, consistent with one or both of the preceding objects.

It is a further object of the invention to carry out one or more of the preceding objects simply and economically.

It is a further object of the invention to provide mass producibility consistent with one or more of the preceding objects.

It is a further object of the invention to utilize existing electrical equipment and provide compatibility therewith consistent with one or more of the preceding objects.

It is a further object of the invention to avoid compromising standards of effectiveness and safety of the existing electrical equipment consistent with one or more of the preceding objects.

SUMMARY OF THE INVENTION

The foregoing objects are accomplished in accordance with the invention by a system in which springy contacts, which may be normally open or normally closed, within an outlet box, are activated by removing line cord plugs, or line cord plug simulators from outlets to trigger an alarm. This is what would happen in case of theft of an appliance, i.e., the thief has to pull the plug or cut the power cord to take away the electrical applicance. The contacts are part of a circuit including a thyristor or relay and an electric utility power or battery operated visual or audible alarm, described below, the thyristor or relay being gated by the change of position of the contacts through removal of the line plug. The contacts may be so affected via a prong of the line plug or via a plunger built into the outlet which is pressed by a prong of the line plug or by the base of the line plug.

Other objects, features and advantages of the invention will be apparent from the following detailed description of the invention taken in connection with the accompanying drawing, in which:

DETAILED DESCRIPTION OF PREFERRED EMBODIMENTS

Figure 1:
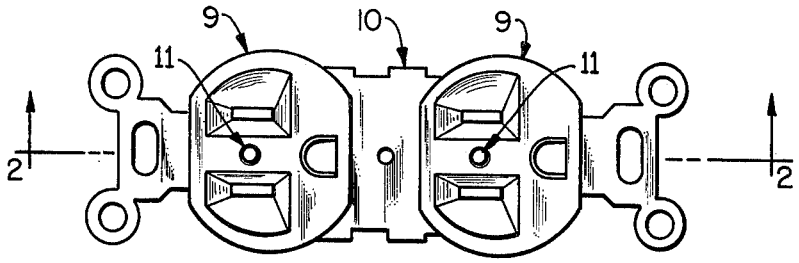
FIG. 1 is a front view and FIG. 2 is a cross-section view, taken as indicated at 2—2 of FIG. 1 of a preferred embodiment of the invention.
Figure 2:
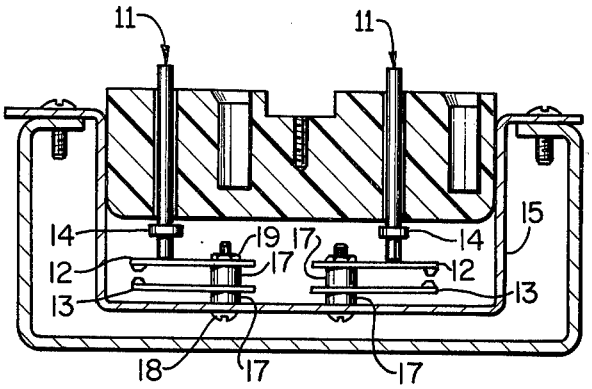
Figure 2A:
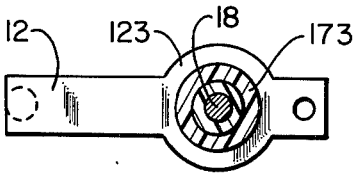
FIGS. 2A and 2B are expanded top and cross-section views of a component of the FIG. 1–2 apparatus.
Figure 2B:
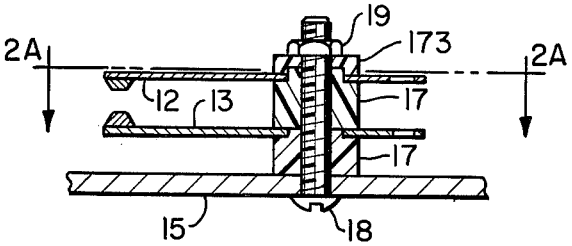

Referring now to FIG. 1–2, there is shown a double electrical outlet fixture 10 comprising two outlets 9 which are modified to contain plungers 11 for bearing against the cantilevered ends of springy electrical contact strips 12 and 13. The strips are mounted on a bracket 15 attached to the double outlet fixture and the plungers 11 are prevented from emerging from the double outlet by collars 14. The switching contacts 12 and 13 are held by a bolt 18 and nut 19 via insulating nested blocks 17, all of which is shown in more detail in FIGS. 2A–2B wherein it is seen that the blocks 17 have chimney extensions 173 accommodating widened out portions 123 (for the contact metal strip 12, there being a similar portion —not shown— for the strip 13).

Figure 3A:
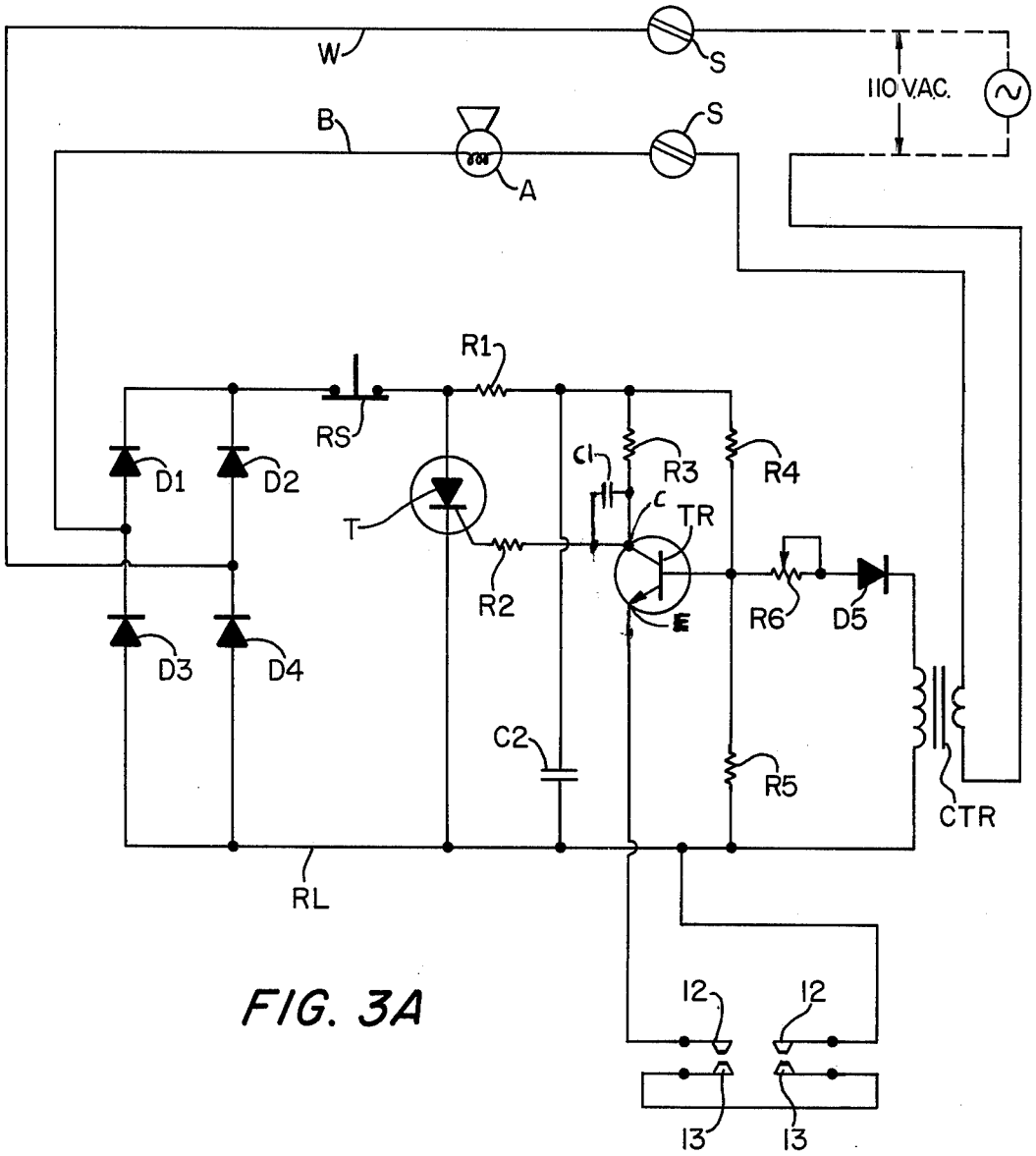
FIGS. 3 and 3A are circuit diagrams of two alarm circuits including the springy switch contacts of the FIG. 1–2 embodiment.
Figure 3:
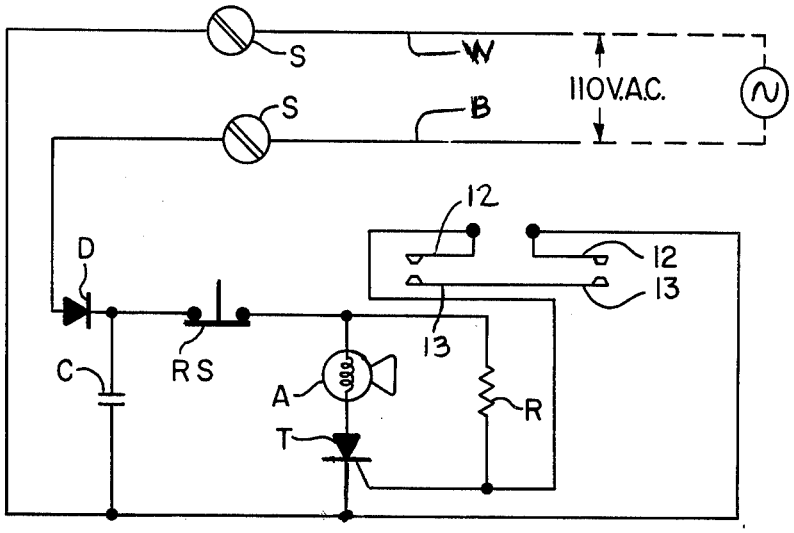

Referring to FIG. 3, there is shown a circuit in which switch contacts 12 and 13 are in circuit with the lines which draw upon 110 volt electrical utility power via the black (B) and white (W) lines. Contact with the outlet 10 is made via screws S and the alternating current so tapped is applied through a rectifier or diode D which converts the alternating current to a positive pulsating direct current. A capacitor C filters the pulsating direct current to a smooth flowing direct current. The direct current is then applied through a reset switch RS, an audible or visible alarm device A and a thyristor or relay T with a bias resistor R connected between the gate and the positive direct current. When a line plug is inserted in the outlet, the switch contacts 12 and 13 are closed, this connects the gate of the thyristor to its cathode keeping it in the off state. When the line plug is removed from the outlet, the thyristor gate is no longer connected to its cathode. Resistor R then biases the thyristor on, allowing current to flow through the alarm, either sounding an audible signal, or if the audible alarm is replaced with a light, a visible light or both. Once the thyristor has been turned on, in this circuit, it will remain on even if its gate is again connected to its cathode. The only way to turn off the alarm is to press the reset button RS which will remove positive voltage from the anode of the thyristor, turning it off, and restoring the circuit to its ready state.

Reset switch RS can be replaced by a key operated switch so that only authorized persons may turn off the alarm.

FIG. 3A shows a circuit in which the alarm can be triggered on if the line cord is cut and/or pulled from its socket. Reference is also made to FIG. 3A: it can be seen that electrical utility power is applied through the white wire W to one of the screws of the outlet 10. The other wire B is passed through the primary of the current transformer CTR and then connected to the other screw S on the outlet 10. When a line plug is inserted into the outlet, contacts 12 and 13 are closed, in this state the circuit of FIG. 3A operates as follows:

Alarm A is placed in series with the black wire B and is connected to one side of a rectifier bridge circuit made up of diodes $D_1$ and $D_3$ to complete the electrical circuit. The white wire W is connected to the other side of the bridge consisting of diodes $D_2$ and $D_4$. The output of the rectifier bridge is a pulsating direct current with a positive polarity at the cathodes of $D_1$ and $D_2$, and a negative polarity at the anodes of $D_3$ and $D_4$. The pulsating direct current is passed through the reset switch RS to the anode of the thyristor T, resistor R, drops the direct current to a safe value for the operation of transistor TR. Resistor $R_3$ form the collector load for TR. Resistor $R_4$ and $R_5$ bias transistor TR on. When transistor TR is on its collector C is a few millivolts above the negative or common reference line RL. This very low voltage is applied through resistor $R_2$, a current limiting resistor, to the gate of the thyristor T and keeps the thyristor turned off.

When the line cord, which is plugged into outlet 10 and is supplied alternating voltage is cut by a metal pliers or the pinching together of the two conductors when the wire is cut by other means, a momentary short circuit takes place causing a large amount of current to flow in the black and white wires. Since the black wire is connected in series through the primary windings of the current transformer CTR, a voltage is induced into the secondary of the current transformer CTR. This voltage is then rectified by diode $D_5$, this negative pulsating direct current is then applied, through variable resistor $R_6$ which can be set to select the correct voltage for the given amount of short circuit current flowing in the primary black wire. The selected negative voltage will then overcome the transistor bias voltage developed across resistor $R_5$. This in turn will change the state of transistor TR from on to off. This then will stop the flow of current through transistor TR and cause the collector of transistor TR to increase in voltage. As this increase in voltage is applied to thyristor T, its gate will cause the thyristor to turn on. Once turned on, the thyristor will short circuit the rectifier bridge and cause the alarm A to be turned on, either sounding an audible or visual alarm. The circuit in FIG. 3A will also respond to the line plugs being removed from the socket as follows: With the line plug plugged into the socket 10 switch contacts 12 and 13 are closed. The emitter of transistor TR is now connected to the negative common reference point RL, with resistors $R_4$ and $R_5$ biasing the transistor TR in the on position, the voltage at the collector C of transistor TR is very low and will not be sufficient to turn thyristor T on. When the line plug is removed from the socket 10, the emitter of transistor TR is now removed from the common reference point RL. This stops current from flowing through the transistor TR and in turn will raise the voltage at the collector of the transistor TR. This rise of voltage will now turn on the thyristor T which will now short circuit the rectifier bridge $D_1$, $D_2$, $D_3$, and $D_4$ and cause current to flow through the alarm making it operate. Once the thyristor has been turned on, the only way it can be turned off externally is by pressing the reset button RS which will remove positive voltage from the anode of the thyristor T.

Typical component values for the FIGS. 3 and 3A circuits are:

FIG. 3 —
R — 22K ohms
C — 250 microfarads
T — 400 p.i.v., 2 amps thyristor
FIG. 3A —
R1 — 17.8K ohms
R2 — 1K ohms
R3 — 4.7K ohms
R4 — 17.8K ohms
R5 — 1K ohms
R6 — zero to 25K ohms
D1-D4 — 400 volts p.i.v. each
D5 — 25 volts p.i.v.
T — 200 p.i.v., 2 amps thyristor
TR — $V_{ce}$ of 60 volts
C1 — .047 microfarads, 100 volts
C2 — 100 microfarads, 25 volts.

Figure 4:
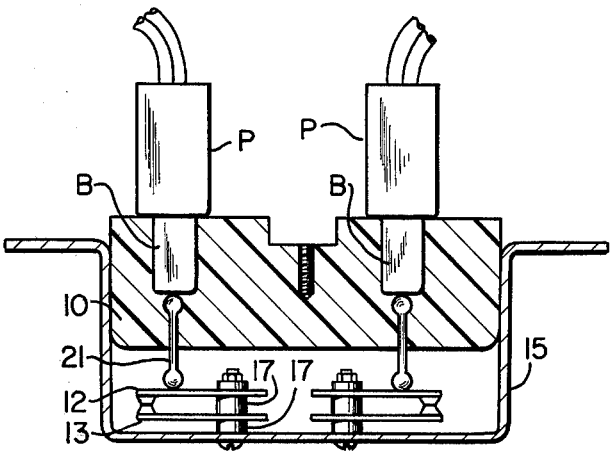
FIGS. 4 and 5 are cross-section views, similar to FIG. 2, of second and third preferred embodiments of the invention, respectively.

Referring now to FIG. 4, there is shown another embodiment of the invention wherein plungers 21 are contacted by the blade prongs B of the outlet plug P to close switching contacts and such contacts are opened by their own springy action when the plug P is removed.

Figure 5:
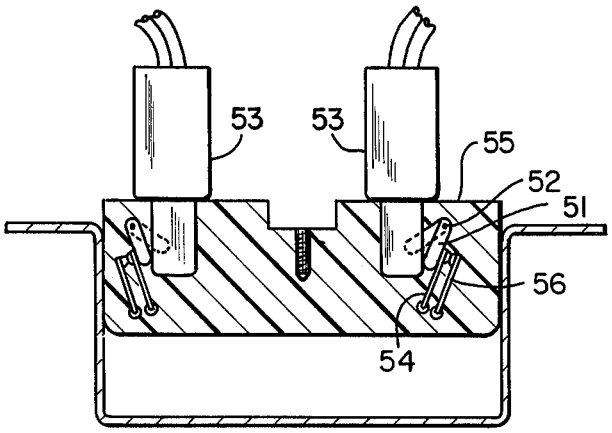

FIG. 5 shows another embodiment of the invention in which insertion of blades B of a power cord plug 53 displaces a pivotal arm 51 about a pivotal axis 52 to close normally open springy contacts 54 and 56, the mounting details and related circuitry of which are essentially as in the previous embodiments. Removal of the plug allows spring action of 54/56 to push arm 51 out of the way and open the switch for operation of an alarm device as described above in connection with FIGS. 3 and/or 3A.

It will be understood that while normally open switch contacts have been described above, an equivalent circuit using normally closed switch contacts can be substituted and that magnetic or other linkages may be substituted for the direct mechanical linkages shown herein. The thyristors used in the described embodiments may be replaced by devices such as solenoids or triacs or other gated relays. The springy contact elements may have external spring means in addition to or in lieu of their internal spring characteristics.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. Electrical appliance theft preventing apparatus usable in connection with appliances having a power cord and plug end plugged into an electrical utility power outlet to define a main circuit and comprising, means defining an auxiliary d.c. circuit with a gated switch whose gating is in a low voltage, low current, portion of the auxiliary circuit and is controlled by an electrical switch thereby with two (cantilevered) spring contact elements both of which are mounted in common at one end, means interconnecting the power cord plug and springy contacts to establish one state of opening/closing of the electrical switch contacts when the plug is in the outlet and to change the state when the plug is removed, means defining an alarm device, means for activating the alarm device under control of said gated switch in the auxiliary circuit the gating being controlled by said change of state to activate the alarm device, and means separate from said electrical switch for resetting the circuit and deactivating the alarm device.

2. Apparatus in accordance with claim 1 wherein the springy contacts have internal spring characteristics and comprise cantilevered metal strips sandwiched between insulator discs for mounting in a common stack.

3. Apparatus in accordance with claim 2 wherein adjacent insulators of the stack have nesting parts to prevent sideslip.

4. Apparatus in accordance with claim 1 and further comprising means for de-activating the alarm device in a preset time interval after activation.

5. Apparatus in accordance with claim 1 and further comprising means for activating said alarm device when the line cord is cut and utilizing the short circuit momentarily created between wires of the line cord as the cord is cut.

* * * * *